US012529281B1

(12) United States Patent
Gonzalez et al.

(10) Patent No.: US 12,529,281 B1
(45) Date of Patent: Jan. 20, 2026

(54) SYSTEM AND METHOD FOR ROTATING CASING STRING VIA A CASING HANGER WITHOUT THREADS

(71) Applicant: Cameron International Corporation, Houston, TX (US)

(72) Inventors: Juan Carlos Gonzalez, Houston, TX (US); Cody Tibbs, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 18/776,325

(22) Filed: Jul. 18, 2024

(51) Int. Cl.
*E21B 33/04* (2006.01)

(52) U.S. Cl.
CPC ..... *E21B 33/04* (2013.01)

(58) Field of Classification Search
CPC ..... E21B 17/08; E21B 33/04; E21B 7/20
See application file for complete search history.

(56) References Cited

U.S. PATENT DOCUMENTS 1,476,554 A * 12/1923 Swanson ..... E21B 33/12 166/123
11,661,807 B1 * 5/2023 Soh ..... E21B 33/04 166/382
2012/0305269 A1 * 12/2012 Bories ..... E21B 33/043 166/208
2017/0167218 A1 * 6/2017 Cheah ..... E21B 23/02
2021/0363861 A1 * 11/2021 Cotton ..... E21B 17/0465

* cited by examiner

*Primary Examiner* — Giovanna Wright
(74) *Attorney, Agent, or Firm* — Jeffrey D. Frantz

(57) ABSTRACT

A system includes a casing hanger that includes a first castellated profile and a casing string that includes a second castellated profile such that the first castellated profile is configured to assemble with the second castellated profile to form a mechanical rotational locking feature configured to enable transfer of a rotational torque between the casing hanger and the casing string.

17 Claims, 9 Drawing Sheets

SYSTEM AND METHOD FOR ROTATING CASING STRING VIA A CASING HANGER WITHOUT THREADS

BACKGROUND

The present disclosure generally relates to tools used to manipulate casing while drilling for resource procurement.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

To meet consumer and industrial demand for natural resources, companies often invest significant amounts of time and money in searching for and extracting oil, natural gas, hydrocarbons, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, pumps, tubing, fluid conduits, and the like, that control drilling or extraction operations.

Common methods include deploying the drilling and production systems on the surface or on a floating platform disposed above the discovered subterranean resources, and drilling the well into the surface of the earth to procure the desired resource(s). As will be appreciated, wells are often lined with casing that generally serves to stabilize the well and to isolate fluids within the wellbore from certain formations penetrated by the well (e.g., to prevent contamination of freshwater reservoirs). Efforts to improve casing installation for resource production may be advantageous.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

In certain embodiments, a system includes a casing hanger that includes a first castellated profile and a casing string that includes a second castellated profile such that the first castellated profile is configured to assemble with the second castellated profile to form a mechanical rotational locking feature configured to enable transfer of a rotational torque between the casing hanger and the casing string.

In certain embodiments, a system includes a casing hanger or a casing string that includes a first inner circumferential surface, a first outer circumferential surface, and a first end annular surface that includes a plurality of grooves and a plurality of protrusions that extend at least partially between the first inner circumferential surface and the first outer circumferential surface, such that the plurality of grooves and the plurality of protrusions combine to create a first castellated profile, such that the first castellated profile is configured to mate with a second castellated profile to create a castellated interface between the casing hanger and the casing string.

In certain embodiments, a method includes mating a first castellated profile of a casing hanger with a second castellated profile of a casing string to form a mechanical rotational locking feature, and transferring a rotational torque between the casing hanger and the casing string via the first and second castellated profiles forming the mechanical rotational locking feature.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
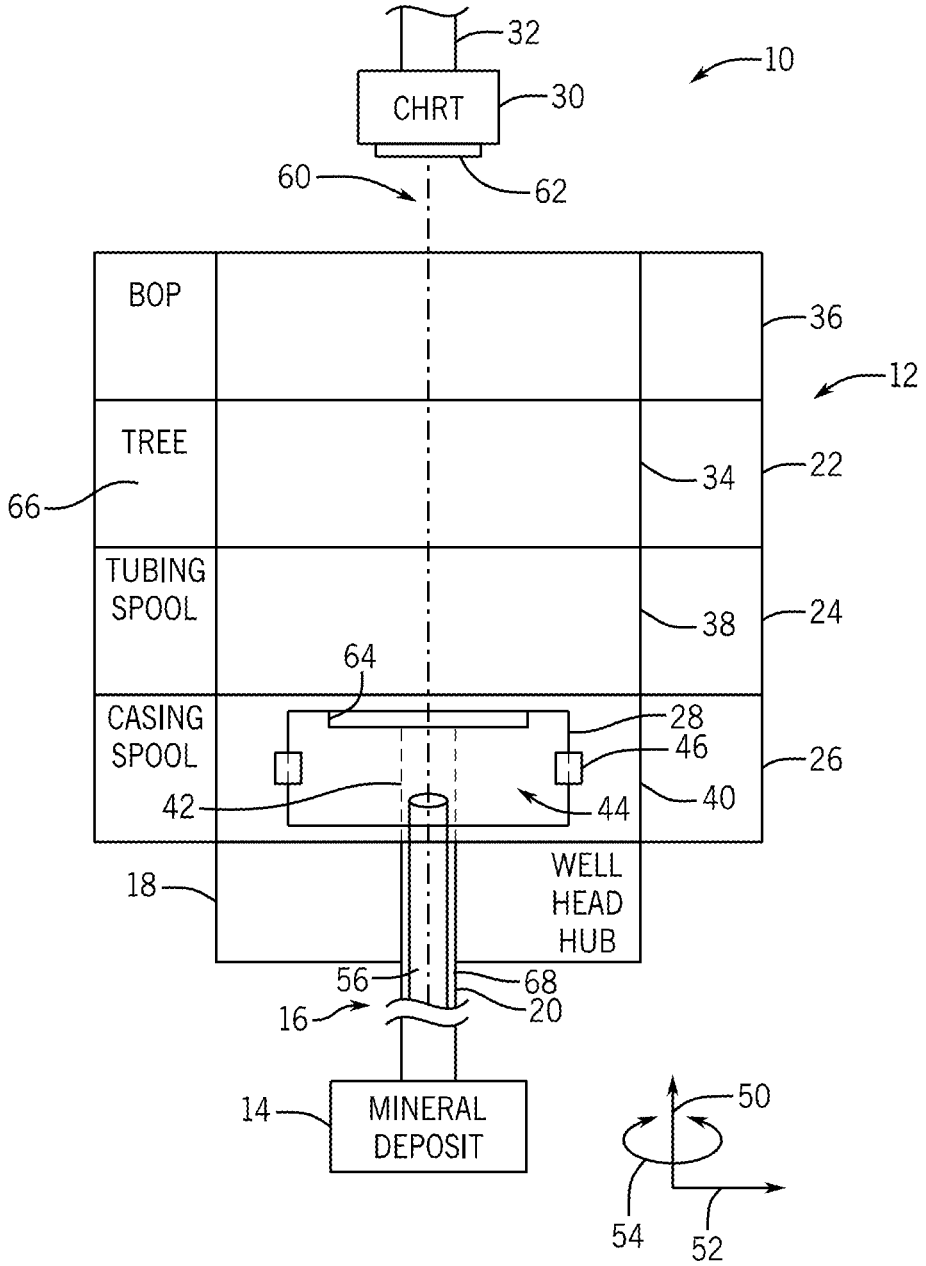
FIG. 1 is a schematic view of a resource extraction system, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Certain terms are used throughout the description and claims to refer to particular features or components. As one skilled in the art will appreciate, different persons may refer to the same feature or component by different names. This document does not intend to distinguish between components or features that differ in name, but not function.

For decades, humans have relied on resources found below the earth's surface to meet increasing energy demands. These resources include but are not limited to natural gas, coal, hydrocarbons, petroleum, and other materials suitable to generate energy for consumption by humans. As energy demands increase, significant efforts are expended to extract an appropriate supply of energy to meet the increasing demand. Included in these efforts are systems and methods that enable expanded extraction of the resources, increase the efficiency of the extraction process, and technological advances that permit extraction and exploration in areas that were previously inaccessible for energy production. For example, one area of exploration that has grown with the advance of energy exploration related technology is the extraction of resources from a portion of the earth's surface where it is not feasible to dispose drilling and production facilities directly above the subterranean resources. Additionally, the extraction of resources from a portion of the earth's surface where the subterranean formation provides additional challenges (hard geological formations, compact rock, etc.) has similarly expanded with the advance of energy exploration related technology.

As one might expect, extracting resources from hard or compact geological formations without being able to drill straight down introduces additional challenges that might not necessarily be present when extracting resources from the earth in a conventional manner. For example, operators may calculate a location for the drilling and production facilities sufficiently laterally spaced from the resources, and determine an arc profile path so that they may maneuver the drill bit and accompanying drill string along the determined path through subterranean formations to approach the desired resources from the side, rather than from above. While certain embodiments for resource procurement may not require equipment configured to direct the drill bit along an arc-shaped path, directional drilling systems utilize an array of drill bits, valves, actuators, motors, seals, sensors, control systems, and other components that work together to enable the operator to direct the drilling components along the determined path through hard subterranean formations. Additionally, installation of a casing string in a wellbore during directional drilling processes may introduce additional steps that may not be utilized during conventional drilling processes.

Casing strings are often cemented in place within the wellbore during initial stages of the drilling operations. During a casing string installation cement job, cement is typically pumped down the casing string, and then a plug is pumped down the casing string with a displacement fluid (e.g., drilling mud) to cause the cement to flow out of the bottom of the casing string and up an annular space between the casing string and the wellbore. While drilling long lateral wellbores through compact, hard subterranean formations, operators may rotate the casing string during the cement job to improve the uniformity of the cement about the casing string and reduce the size or frequency of undesirable cavities or fissures in the cement. In contrast to the embodiments discussed below, methods for rotating the casing string include complex threaded connections between the casing string and a casing hanger, and these threaded connections may vary amongst drilling and production facilities. As a result, efforts to improve an interface between the casing hanger and the casing string may be advantageous.

The present disclosure relates to a design of a threadless interface between the casing hanger and the casing string that enables the casing hanger to transmit a rotational torque to the casing string. Present embodiments include a casing hanger configured to include a cylindrical chamber with multiple grooves (e.g., annular grooves) disposed along an interior circumferential surface of the cylindrical chamber. The cylindrical chamber of the casing hanger may slide over an outside circumferential surface of the casing string, such that the casing hanger and the casing string have a predetermined length of axial overlap between the two components. Once the casing hanger is in place around the casing string, an expansion tool may be introduced into an inner circumferential surface of the casing string, and the expansion tool may enact a radial force onto the inner circumferential surface of the casing string, thereby cold working the outer surface of the casing string to form protrusions (e.g., annular protrusions) that expand radially into the grooves of the interior circumferential surface of the cylindrical chamber of the casing hanger. By virtue of this expansion, the protrusions from the casing string interface with the grooves of the casing hanger, thereby creating a metal-to-metal seal between the casing string and the casing hanger and enabling the casing hanger to support the weight of the casing string in the axial direction.

In the present disclosure, in addition to the protrusion/groove interface between the casing hanger and the casing string, the casing string includes a mechanical rotational locking feature that may be disposed in a top annular surface of the casing string. In certain embodiments, the mechanical rotational locking feature may include a castellated profile that includes a pattern of protrusions and grooves rotationally spaced around the outer circumferential surface of the casing string. In some embodiments, each protrusion and groove may extend in an axial direction along a length of the casing string. Additionally, the casing hanger may include an additional mechanical rotational locking feature that is configured to assemble with the mechanical rotational locking feature of the casing string. As a result, an axial protrusion from the additional mechanical rotational locking feature of the casing hanger may slide into a corresponding axial groove of the mechanical rotational locking feature of the casing string. With the mechanical rotational locking features assembled together in an engaged position, and in combination with the metal-to-metal seal connection discussed previously, the casing hanger may support the weight of the casing string in an axial direction (e.g., a direction of the wellbore), while additionally transferring a torque to the casing string to enable casing string rotation via a threadless connection, even through compact, hard subterranean formations and extended lateral spaces during the drilling operations.

Turning to the drawings, FIG. 1 is a block diagram of an embodiment of a resource extraction system 10. The resource extraction system 10 may be configured to extract various minerals and natural resources, including hydrocarbons (e.g., oil and/or natural gas), from the earth. Additionally or alternatively, the resource extraction system 10 may be configured to inject substances into the earth. The resource extraction system 10 may be land-based (e.g., surface system) or subsea (e.g., a subsea system). As shown, the resource extraction system 10 includes a wellhead 12 coupled to a mineral deposit 14 via a well 16. The well 16 includes a wellhead hub 18 and a wellbore 20. The wellhead hub 18 may include a large diameter hub that is disposed at the termination of the wellbore 20. The wellhead hub 18 provides for the connection of the wellhead 12 to the well 16.

The wellhead 12 includes multiple components that control and regulate activities and conditions associated with the well 16. For example, the wellhead 12 may include bodies, valves, and seals that route produced minerals from the mineral deposit 14, regulate pressure in the well 16, and/or inject chemicals into the wellbore 20. In the illustrated embodiment, the wellhead 12 includes a tree 22, a tubing spool 24 (e.g., housing), a casing spool 26 (e.g., housing), and a casing hanger 28. The resource extraction system 10 may include other device(s) that are coupled to the wellhead 12 that are used to assemble and/or control various components of the wellhead 12. For example, in the illustrated embodiment, the resource extraction system 10 includes a casing hanger running tool (CHRT) 30 suspended from the drill string 32. During a running or lowering process for the casing hanger 28, the CHRT 30 is threadably coupled to the casing hanger 28. In the illustrated embodiment, the CHRT 30 includes a male threaded connection interface 62 and the casing hanger 28 includes a female threaded connection interface 64. In some embodiments, the CHRT 30 may include a female threaded connection interface and the casing hanger may include a male threaded connection interface. After they are coupled together, the CHRT 30 and the casing hanger 28 are lowered (e.g., run) together into the wellhead 12. Once the casing hanger 28 has been lowered into a landed position in the casing spool 26, the casing hanger 28 may be locked into a locked position in the casing spool 26. Then, the CHRT 30 may be uncoupled from the casing hanger 28 and extracted from the wellhead 12 by the drilling string 32.

The tree 22 may include a variety of flow paths (e.g., bores), valves, fittings, and controls for operating the well 16. For instance, the tree 22 may include a frame 66 that is disposed about a flow-loop, actuators, and valves. Further, the tree 22 may be in fluid communication with the well 16. As illustrated, the tree 22 includes a tree bore 34. The tree bore 34 provides for completion and workover procedures, such as the insertion of tools into the wellhead 12, the injection of various chemicals into the well 16, and the like. Further, minerals extracted from the well 16 (e.g., oil and/or natural gas) may be regulated and routed via the tree 22. For instance, the tree 22 may be coupled to a jumper or a flowline that is tied back to other components, such as a manifold. Accordingly, produced minerals flow from the well 16 to the manifold via the tree 22 before being routed to shipping or storage facilities. A blowout preventer (BOP) 36 may also be included, either as a part of the tree 22 or as a separate device. As illustrated, the BOP 36 is disposed on top of the tree 22. The BOP 36 may include a variety of valves, fittings, and controls to block oil, gas, or other fluid from exiting the well in the event of an unintentional release of pressure or an overpressure condition. It should be appreciated that a lubricator may be utilized in place of the BOP 36 (e.g., to deploy components into the wellhead 12).

The tubing spool 24 provides a base for the tree 22. The tubing spool 24 has a tubing spool bore 38, and the casing spool 26 has a casing spool bore 40. The bores 38 and 40 connect (e.g., enable fluid communication between) the tree bore 34 and the well 16. Thus, the bores 38 and 40 may provide access to the wellbore 20 for various completion and workover procedures. For example, components may be run down to the wellhead 12 and disposed in the tubing spool bore 38 and/or the casing spool bore 40 to seal-off the wellbore 20, to inject chemicals downhole, to suspend tools downhole, to retrieve tools, and the like.

The wellbore 20 may contain elevated fluid pressures. For example, pressures within the wellbore 20 may exceed 10,000 pounds per square inch (PSI), 15,000 PSI, or 20,000 PSI. Accordingly, resource extraction systems 10 employ various mechanisms, such as mandrels, seals, plugs, and valves, to control and regulate the well 16. For example, the casing hanger 28 may be disposed within the casing spool 26 to secure casing strings 56 suspended in the wellbore 20 and to provide a path for hydraulic control fluid, chemical injection, electrical connection(s), and the like. The casing hanger 28 includes a central bore 42 that extends through the center of a body 44 of the casing hanger 28 and that is in fluid communication with the tubing spool bore 38 and the wellbore 20. The central bore 42 is configured to facilitate flow of hydrocarbons through the body 44 of the casing hanger 28.

As shown, a lock ring 46 (e.g., metal ring; c-shaped ring) may be coupled to the casing hanger 28, such that the lock ring 46 is disposed between the casing spool 26 and the casing hanger 28. After the casing hanger 28 reaches the landed position in the casing spool 26, the lock ring 46 may be released (e.g., expanded; set) to cause the casing hanger 28 to be in the locked position in the casing spool 26. For example, rotation and/or withdrawal of the CHRT 30 may enable the lock ring 46 to expand radially-outwardly to engage the casing spool 26. Once the lock ring 46 is engaged with the casing spool 26, the lock ring 46 may block withdrawal or extraction of the casing hanger 28 from the casing spool 26. To facilitate discussion, the resource extraction system 10 and its components may be described with reference to an axial axis or direction 50, a radial axis or direction 52, and a circumferential axis or direction 54. Additionally, the casing hanger 28 and the lock ring 46 may together be considered to form an insert or a hanger assembly. Furthermore, the casing hanger 28, the CHRT 30, and the lock ring 46 may together be considered to form a hanger running assembly.

The casing hanger 28 may couple to and suspend the casing string 56 in the wellbore 20. Additionally, the casing hanger 28 is configured to center the casing string 56 in the wellbore 20 and align the casing string 56 with a centerline 60 of the well 16. In certain embodiments, the casing string 56 may be installed and cemented into place in the wellbore 20. During a cement job, cement is typically pumped down the casing string 56, and then a plug is pumped down the casing string 56 by a displacement fluid to cause the cement to flow out of a bottom end of the casing string 56 and up an annular space 68 between the casing string 56 and the wellbore 20. As discussed previously, due to long lateral runs and/or hard subterranean geological conditions, enabling the casing hanger 28 to rotate the casing string 56 in the wellbore 20 while the cement dries may reduce the size and the frequency of cavities or fissures in the cement.

Figure 2:
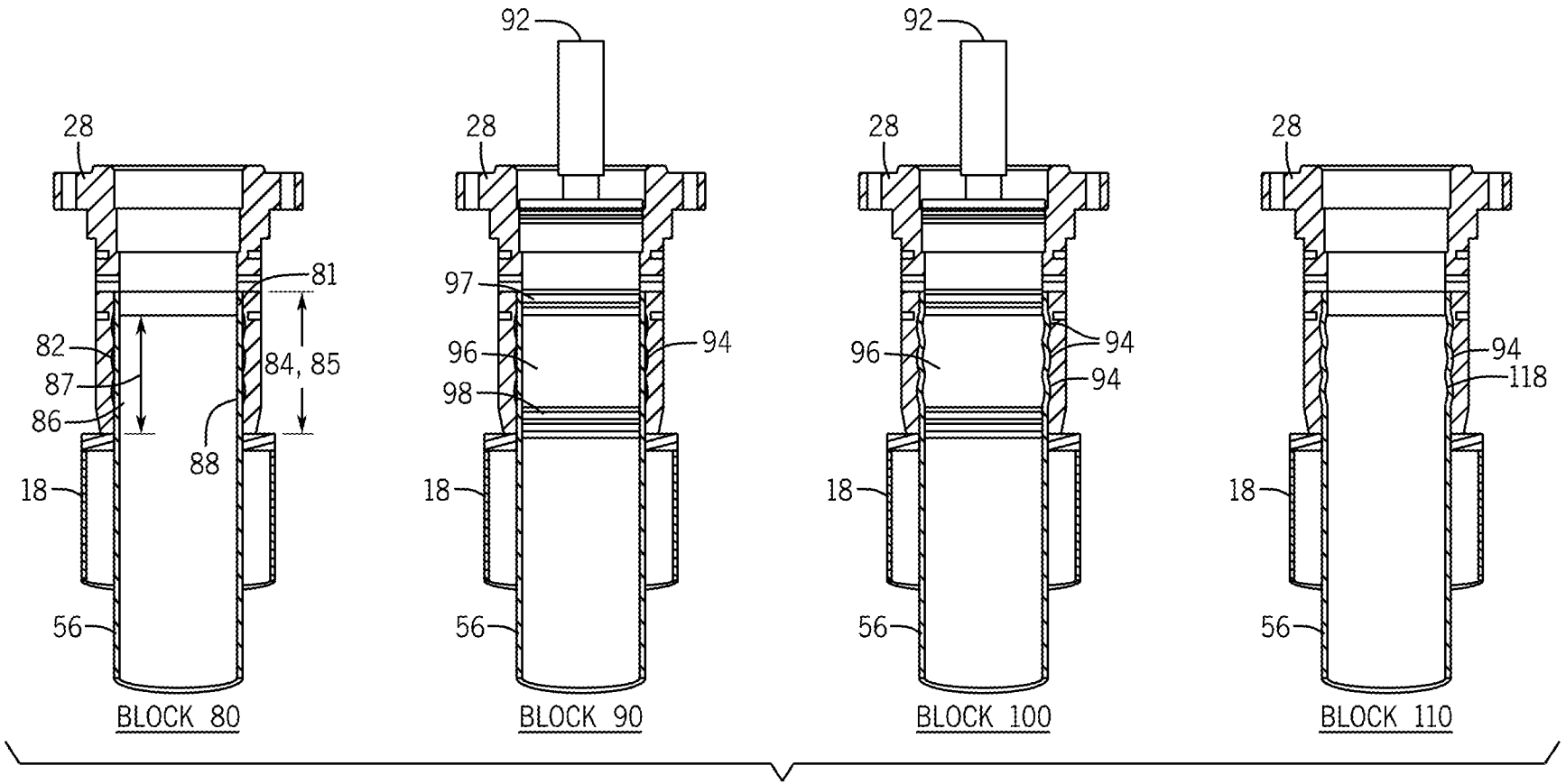
FIG. 2 is a schematic view of various steps taken to create a connection interface between a casing hanger and a casing string, in accordance with aspects of the present disclosure.

Turning to FIG. 2, a process for coupling the casing hanger 28 to the casing string 56 is illustrated in a series of steps, as shown in blocks 80, 90, 100 and 110. In Block 80, the casing hanger 28 includes a cylindrical chamber 81 configured to receive the casing string 56. In the illustrated embodiment, the cylindrical chamber 81 includes an inner circumferential surface 82 that extends for a depth 84. As illustrated, a portion of the casing string 56 is shown to extend in an axial direction above the wellhead hub 18 for an axial distance 85. The portion of the casing string 56 that extends above the wellhead hub 18 assembles into the cylindrical chamber 81 of the casing hanger 28, thereby creating an axial overlap distance 87 between the casing hanger 28 and the casing string 56. In certain embodiments, the axial overlap distance 87 between the casing hanger 28 and the casing string 56 directly corresponds to (e.g., is equal to, proportional to, substantially similar to, etc.) the depth 84 of the cylindrical chamber 81 and the axial distance 85.

The casing string 56 includes an outer circumferential surface 86 (e.g., outer annular surface) that is configured to translate proximate to the inner circumferential surface 82 (e.g., inner annular surface) of the casing hanger 28. In certain embodiments, when assembled into the cylindrical chamber 81 of the casing hanger 28, a radial gap (e.g., 0.050", 1/16", 0.075", etc.) is present between the inner circumferential surface 82 of the casing hanger 28 and the outer circumferential surface 86 of the casing string 56. Additionally, the casing string 56 includes an inner circumferential surface 88 that is configured to enable fluid communication between the well 16 and the wellhead 12.

Further, the inner circumferential surface 88 of the casing string 56 is configured to receive a tool 92 for coupling the casing string 56 to the casing hanger 28. In Block 90, the tool 92 assembles through the casing hanger 28 and into the inner circumferential surface 88 of the casing string 56. As illustrated, the tool 92 is lowered into casing string 56 until an inflatable diaphragm 96 of the tool 92 is substantially aligned with a portion of the inner circumferential surface 82 of the casing hanger 28 that includes multiple radial grooves 94 (e.g., annular grooves that extend in a radial direction) disposed in the inner circumferential surface 82. In the illustrated embodiment, the inner circumferential surface 82 of the casing hanger 28 includes three (3) radial grooves 94, however, it is envisioned that the inner circumferential surface 82 of the casing hanger 28 may include more or fewer (e.g., 1, 2, 4, 5, 6, 7, 8, etc.) radial grooves 94. Additionally, the radial grooves 94 and the inflatable diaphragm 96 are both substantially aligned with the axial overlap distance 87 between the casing hanger 28 and the casing string 56, as discussed during the description of Block 80. In certain embodiments, the tool 92 includes a first radial seal 97 (e.g., annular seal that extends in a radial direction) disposed above the inflatable diaphragm 96 and a second radial seal 98 (e.g., annular seal that extends in a radial direction) disposed below the inflatable diaphragm 96. As a result of this seal arrangement, the tool 92 enables a pressure force to be applied to an isolated portion of the casing string that is in contact with the inflatable diaphragm 96.

In Block 100, with the tool 92 and inflatable diaphragm 96 in the illustrated position, the tool 92 causes the inflatable diaphragm 96 to expand, thereby enacting a radial force onto the inner circumferential surface 88 of the casing string 56. Due to the radial force, the outer circumferential surface 86 of the casing string 56 expands and deforms into the radial grooves 94 of the inner circumferential surface 82 of the casing hanger 28. For example, in certain embodiments where the inner circumferential surface 82 of the casing hanger 28 includes three (3) radial grooves, the radial force causes the outer circumferential surface 86 of the casing string to form three (3) corresponding radial protrusions 118 (e.g., annular protrusions that extend in a radial direction) that fit into the radial grooves 94 of the casing hanger 28.

In Block 110, the tool 92 causes the inflatable diaphragm 96 to deflate so that the tool may be removed from the casing string 56 and the casing hanger 28. As illustrated in Block 110, and described previously in Block 100, the outer circumferential surface 86 of the casing string 56 includes multiple radial protrusions 118 as a result of the radial force. The radial protrusions 118 and the radial grooves 94 couple the casing hanger 28 with the casing string 56 and enable the casing hanger 28 to suspend the casing string 56 in the wellbore 20. Additionally, the radial protrusions 118 and the radial grooves 94 create a metal-to-metal seal between the casing hanger 28 and the casing string 56, thereby enabling fluid communication between the well 16 and the wellhead 12, without introducing a potential leak path.

Figure 3:
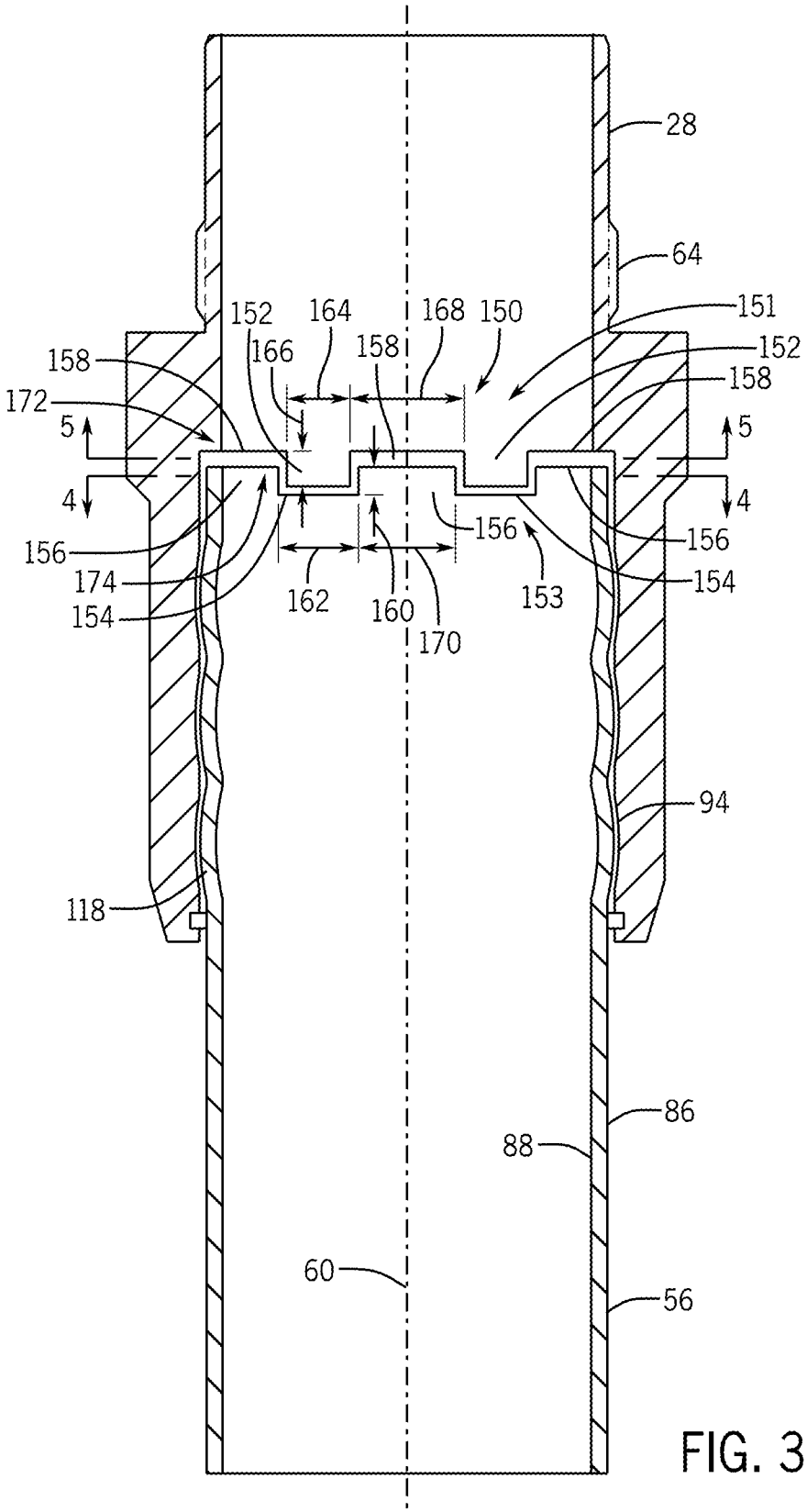
FIG. 3 is a cross-sectional side view of an assembly of the casing hanger and the casing string, in accordance with aspects of the present disclosure.

FIG. 3 illustrates a schematic view of an embodiment of a mechanical rotational locking feature 150 between the casing hanger 28 and the casing string 56. As discussed previously, the mechanical rotational locking feature 150 enables the casing hanger 28 to transmit a rotational torque to the casing string 56 without using a threaded connection between the casing hanger 28 and the casing string 56. In the illustrated embodiment, the mechanical rotational locking feature 150 includes an annular castellated profile 151 having an alternating arrangement of multiple hanger protrusions 152 and hanger grooves 158, and an annular castellated profile 153 having an alternating arrangement of multiple string grooves 154 and string protrusions 156. For example, the annular castellated profile 151 alternates between the hanger protrusions 152 and the hanger grooves 158 in a circumferential direction about a central axis of the casing hanger 28, while the annular castellated profile 153 alternates between the string grooves 154 and the string protrusions 156 in a circumferential direction about a central axis of the casing string 56. The hanger protrusions 152 are configured to assemble into the string grooves 154, and the hanger grooves 158 are configured to receive the string protrusions 156. In the illustrated embodiment, the annular castellated profile 151 of the hanger protrusions 152 and the hanger grooves 158 is disposed on an axial end surface 172 of the casing hanger 28, while the annular castellated profile 153 of the string grooves 154 and the string protrusions 156 is disposed on an axial end surface 174 of the casing string 56. In certain embodiments, the annular castellated profile 151 may be disposed on the axial end surface 172, an outer annular surface, an inner annular surface, or a combination thereof, of the casing hanger 28, while the annular castellated profile 153 may be disposed on the axial end surface 174, an outer annular surface, an inner annular surface, or a combination thereof, of the casing string 56.

In certain embodiments, the annular castellated profiles 151 and 153 are configured to circumferentially align and axially mate with one another, such that the hanger protrusions 152 axially extend into the string grooves 154 and the hanger grooves 158 axially receive the string protrusions 156. Thus, the annular castellated profiles 151 and 153 have matching profiles with some tolerances in sizes to enable the axial mating. Each of the protrusions (e.g., hanger protrusions 152 and string protrusions 156) and each of the grooves (e.g., hanger grooves 158 and string grooves 154) generally has a rectangular profile (e.g., rectangular protrusions and rectangular grooves). In some embodiments, as shown in Table 1 below, each of the protrusions (e.g., hanger protrusions 152 and string protrusions 156) and each of the grooves (e.g., hanger grooves 158 and string grooves 154) may generally have other geometric shape profiles, including but not limited to triangular profiles (e.g., triangular protrusions and triangular grooves) and wave profiles (e.g., curved or U-shaped protrusions and curved or U-shaped grooves). In certain embodiments, the annular castellated profiles 151 and 153 may have uniformly sized and/or spaced protrusions (e.g., hanger protrusions 152 and string protrusions 156), uniformly sized and/or spaced grooves (e.g., hanger grooves 158 and string grooves 154), or a combination thereof. However, in some embodiments, the annular castellated profiles 151 and 153 may have non-uniformly sized and/or spaced protrusions (e.g., hanger protrusions 152 and string protrusions 156), non-uniformly sized and/or spaced grooves (e.g., hanger grooves 158 and string grooves 154), or a combination thereof. Additionally, in certain embodiments, the annular castellated profiles 151 and 153 may be integrally formed (e.g., cast, machined, etc.) onto the axial end surfaces 172 and 174 of the respective casing hanger 28 and the casing string 56 to form respective one-piece structures. However, in some embodiments, the annular castellated profiles 151 and 153 may be separate structures that are fixedly coupled to (e.g., welded to) or removably coupled to (e.g., bolted or secured with removable fasteners to) the respective casing hanger 28 and the casing string 56.

TABLE 1

Example groove and protrusion profiles

| Pattern Name | Profile Example |
|---|---|
| Rectangular Pattern | |
| Triangular Pattern | |
| Wave Pattern | |

In certain embodiments, the string grooves 154 have a specified width 162 and a particular depth 160. Additionally, the string protrusions 156 have a specified width 170 and an equal depth 160 as the string grooves 154. In some embodiments, each string groove 154 of the multiple string grooves 154 may have the same width and the same depth, while in other embodiments, the width and depth may vary between the multiple string grooves 154. In other embodiments, the string groove 154 and string protrusions 156 may have equal widths 162, 170 in addition to equal depths 160.

In certain embodiments, the hanger protrusions 152 may have a specified width 164 and a particular depth 166. Additionally, the hanger grooves 158 have a specified width 168 and an equal depth 166 as the hanger protrusions 152. In some embodiments, each hanger protrusion 152 of the multiple hanger protrusions may have the same width and the same depth, while in other embodiments, the width and depth may vary between the multiple hanger protrusions 152. In other embodiments, the hanger grooves 158 and hanger protrusions 152 may have equal widths 164, 168 in addition to equal depths 166. In this way, in embodiments where all grooves and protrusions have the same width and depth, the casing string 56 may install into the casing hanger 28 in any rotational orientation. However, in embodiments where the grooves and protrusions have dissimilar widths and depths, the casing string 56 may install into the casing hanger 28 in a limited (e.g., one or two) rotational orientation.

In the illustrated embodiment, the string groove width 162 is greater than the hanger protrusion width 164 so that the protrusion may assemble into the associated groove. In certain embodiments, the string groove width 162 is greater than the hanger protrusion width 164 by a specified amount (e.g., 1/16", 1"8", 3/16", etc.) thereby facilitating installation and engagement of the mechanical rotational locking feature 150. Additionally, the hanger groove width 168 is greater than the string protrusion width 170 so that the protrusion may assemble into the associated groove. In certain embodiments, the hanger groove width 168 is greater than the string protrusion width 170 by a specified amount (e.g., 1/16", 1"8", 3/16", etc.) thereby facilitating installation and engagement of the mechanical rotational locking feature.

Figure 4:
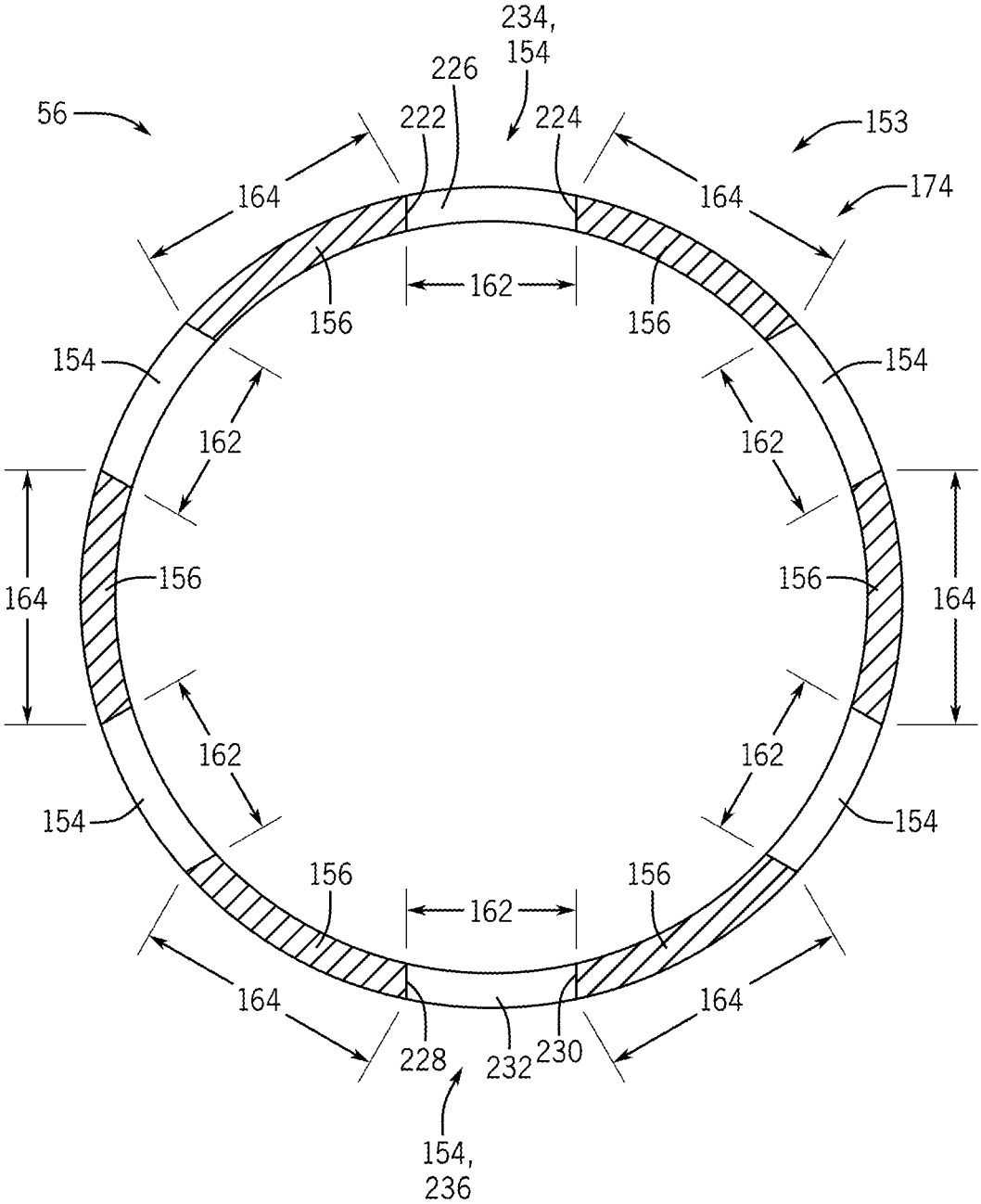
FIG. 4 is a cross-sectional end view of an embodiment of the casing string, in accordance with aspects of the present disclosure.

FIG. 4 illustrates a cross-sectional end view of an embodiment of a casing string 56 having the annular castellated profile 153 of FIG. 3 taken alone line 4-4, according to aspects of the present disclosure. In the illustrated embodiment, the casing string 56 has the annular castellated profile 153 with the alternating arrangement of multiple string grooves 154 and string protrusions 156 that are spaced circumferentially around the casing string 56 along the axial end surface 174. In the illustrated embodiment, the annular castellated profile 153 includes six (6) string grooves 154 and six (6) string protrusions 156, however, greater or fewer grooves and protrusions (1, 2, 3, 4, 5, 7, 8, etc.) are considered within the scope of the present disclosure. In some embodiments, the number of string grooves 154 may be equal to the number of string protrusions 156 included on the casing string 56. In other embodiments, the number of string grooves 154 may be greater or fewer than the number of string protrusions 156.

In the illustrated embodiment, and as discussed previously, the string grooves 154 have a width 162 and the string protrusions 156 have a width 170. As illustrated, the string protrusion width 170 is greater than the string groove width 162. However, in other embodiments, the string groove width 162 may be greater than the string protrusion width 170. In yet other embodiments, the string groove width 162 may be equal to the string protrusion width 170.

In the illustrated embodiment, a first string groove 154, 234 includes a first string surface 222, a second string surface 224, and a third string surface 226 that define the geometry of the first string groove 154, 234 in the casing string 56. For example, the first string surface 222 and the second string surface 224, and an associated length between the two surfaces defines the string groove width 162. In certain embodiments, the first string surface 222 and the second string surface 224 may be substantially planar surfaces that are parallel with one another. In some embodiments where the casing string 56 includes a mechanical rotational locking feature 150 with an even (e.g., 2, 4, 6, 8, etc.) number of grooves 154 in the casing string, the first string groove 154, 234 may be disposed directly opposite from a second string groove 154, 236. In such an embodiment, the first string surface 222 of the first string groove 154, 234 may share the same plane as a fourth string surface 228 of the second string groove 154, 236, and the second string surface 224 of the first string groove 154, 234 may share the same plane as a fifth string surface 230 of the second string groove 154, 236. In other embodiments, the first string surface 222 and the second string surface 224 may not be parallel with one another.

In certain embodiments, the first string groove 154, 234 includes a third string surface 226 and the second string groove 154, 236 includes a sixth string surface 232. The third string surface 226 and the sixth string surface 232 make up a base surface of the respective string grooves. For example, the third string surface 226 combined with a first end annular surface of the casing string 56, and an associated length between the first end annular surface and the third string surface 226 defines a depth of the first string groove 154, 234. In some embodiments, the third string surface 226 is a planar surface that substantially shares a similar plane as the sixth string surface 232, thereby ensuring that the two grooves 234, 236 have similar depths. In other embodiments, the third string surface 226 and the sixth string surface 232 may sit in different planes, and as a result, the first string groove 154, 234 may have a different string groove depth 160 from the second string groove 154, 236.

Figure 5:
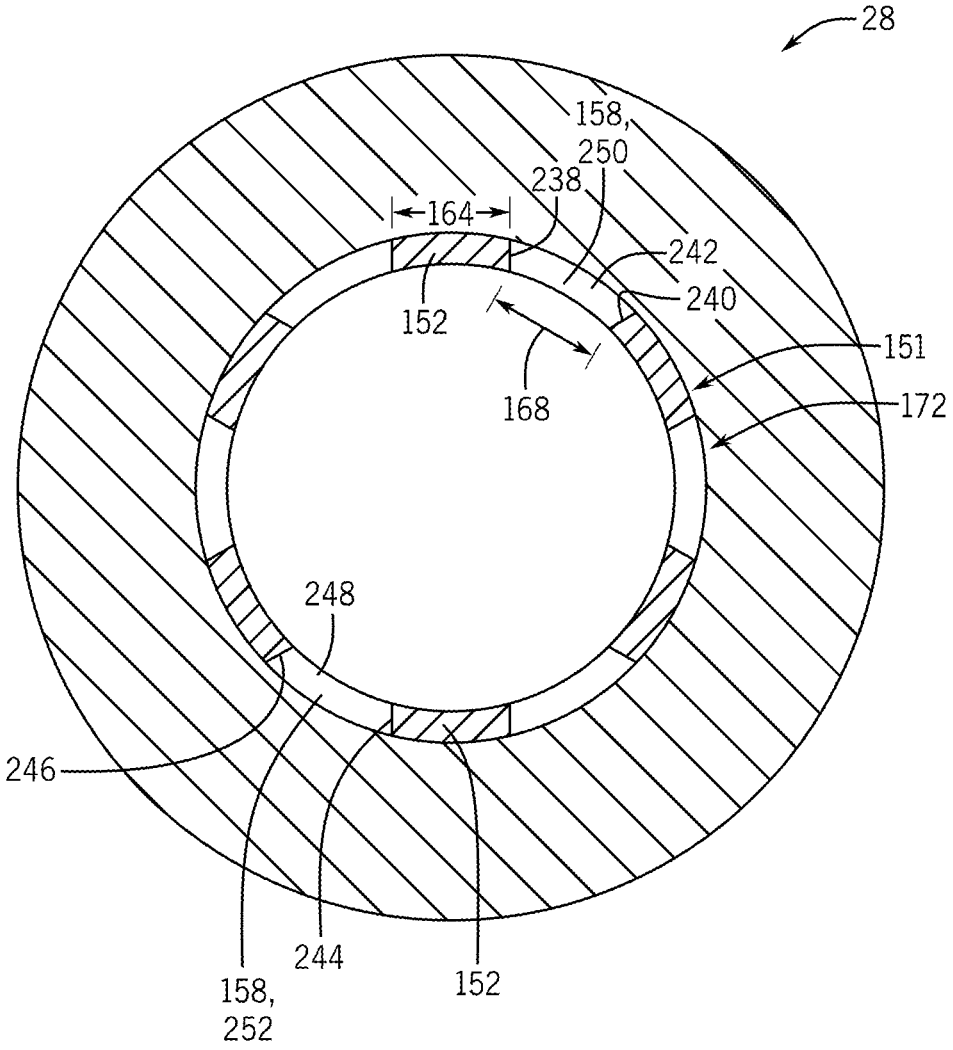
FIG. 5 is a cross-sectional end view of an embodiment of the casing hanger, in accordance with aspects of the present disclosure.

FIG. 5 illustrates a cross-sectional end view of an embodiment of a casing hanger 28 having the annular castellated profile 151 of FIG. 3 taken along line 5-5, according to aspects of the present disclosure. In the illustrated embodiment, the casing hanger 28 has the annular castellated profile 151 with an alternating arrangement of multiple hanger grooves 158 and hanger protrusions 152 that are spaced circumferentially around the casing hanger 28 at the axial end surface 172. In the illustrated embodiment, the annular castellated profile 151 includes six (6) hanger grooves 158 and six (6) hanger protrusions 152, however, greater or fewer grooves and protrusions (1, 2, 3, 4, 5, 7, 8, etc.) are considered within the scope of the present disclosure. In some embodiments, the number of hanger grooves 158 may be equal to the number of hanger protrusions 152 included on the casing hanger 28. In other embodiments, the number of hanger grooves 158 may be greater or fewer than the number of hanger protrusions 152.

In the illustrated embodiment, and as discussed previously, the hanger grooves 158 have a width 168 and the hanger protrusions 152 have a width 164. As illustrated, the hanger groove width 168 is greater than the hanger protrusion width 164. However, in other embodiments, the hanger protrusion width 164 may be greater than the hanger groove width 168. In yet other embodiments, the hanger groove width 168 may be equal to the hanger protrusion width 164.

In the illustrated embodiment, a first hanger groove 158, 250 includes a first hanger surface 238, a second hanger surface 240, and a third surface 242 that define the geometry of the first hanger groove 158, 250 in the casing hanger 28. For example, the first hanger surface 238 and the second hanger surface 240, and an associated length between the two surfaces defines the hanger groove width 168. In certain embodiments, the first hanger surface 238 and the second hanger surface 240 may be substantially planar surfaces that are parallel with one another. In some embodiments where the casing hanger 28 includes a mechanical rotational locking feature 150 with an even (e.g., 2, 4, 6, 8, etc.) number of grooves 158 in the casing hanger, a first hanger groove 158, 250 may be disposed directly opposite from a second hanger groove 158, 252. In such an embodiment, the first hanger surface 238 of the first hanger groove 158, 250 may share the same plane as a fourth hanger surface 244 of the second hanger groove 158, 252, and the second hanger surface 240 of the first hanger groove 158, 250 may share the same plane as a fifth hanger surface 246 of the second hanger groove 158, 252. In other embodiments, the first hanger surface 238 and the second hanger surface 240 may not be parallel with one another.

In certain embodiments, the first hanger groove 158, 250 includes a third hanger surface 242 and the second hanger groove 158, 252 includes a sixth hanger surface 248. The third hanger surface 242 and the sixth hanger surface 248 make up a base surface of the respective hanger grooves. For example, the third hanger surface 242 combined with a first end annular surface of the casing hanger 28, and an associated length between the first end annular surface and the third hanger surface 242 defines a depth of the first hanger groove 158, 250. In some embodiments, the third hanger surface 242 is a planar surface that substantially shares a similar plane as the sixth hanger surface 248, thereby ensuring that the two hanger grooves 250, 252 have similar depths. In other embodiments, the third hanger surface 242 and the sixth hanger surface 248 may sit in different planes, and as a result, the first hanger groove 158, 250 may have a different hanger groove depth 166 from the second hanger groove 158, 252.

Figure 6:
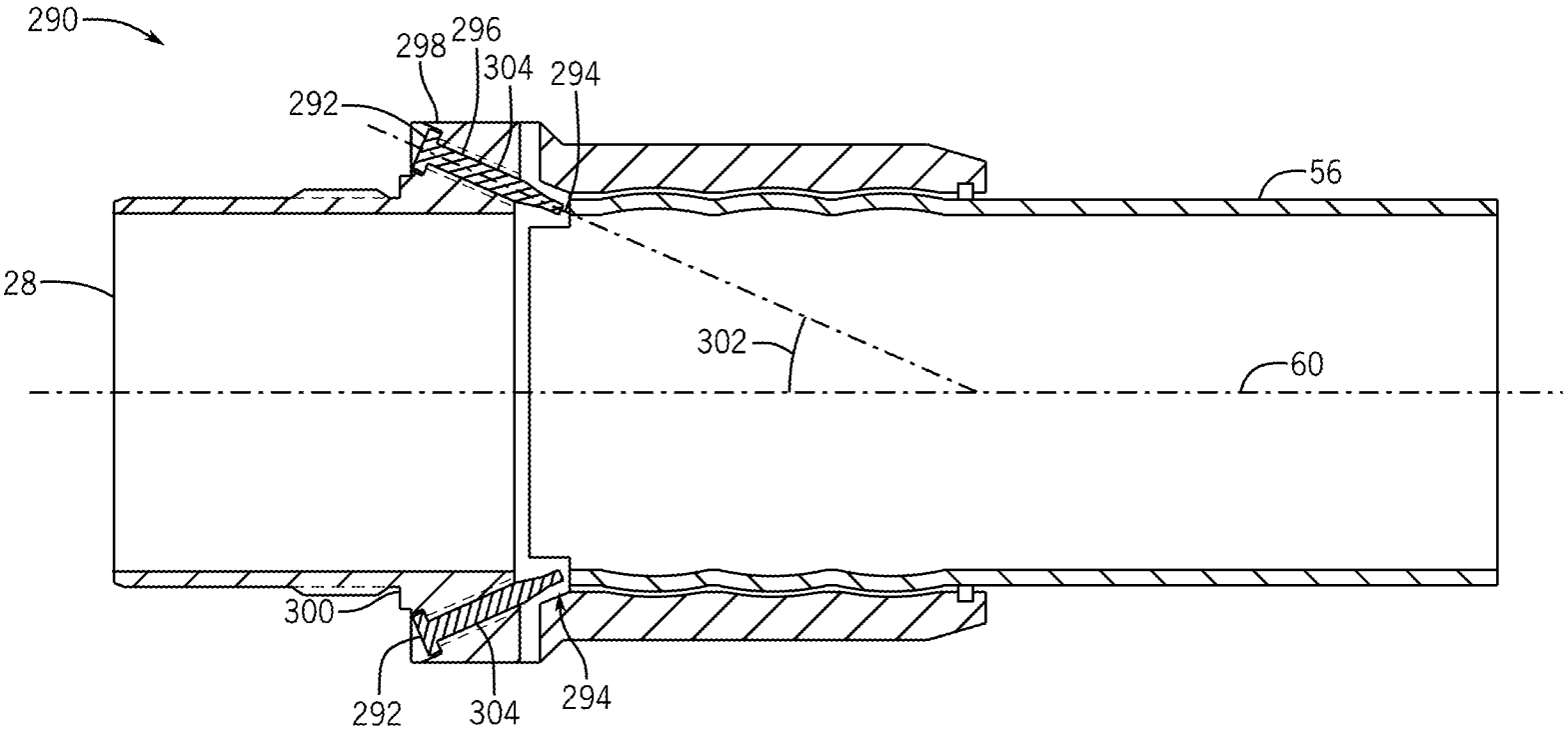
FIG. 6 is a cross-sectional side view of an embodiment for a mechanical rotational locking feature between the casing string and the casing hanger, in accordance with aspects of the present disclosure.

FIG. 6 illustrates a cross-sectional side view of an embodiment of an alternative mechanical rotational locking feature 290 between the casing hanger 28 and the casing string 56. As discussed previously, the mechanical rotational locking feature 290 enables the casing hanger 28 to transmit a rotational torque to the casing string 56 without using a threaded connection between the casing hanger 28 and the casing string 56 (e.g., without threading together annular surfaces of the casing hanger 28 and the casing string 56). In the illustrated embodiment, the mechanical rotational locking feature 290 includes multiple fasteners 292 (e.g., threaded fasteners or bolts) that are configured to assemble into a string groove 294 in the casing string 56. As illustrated, the casing hanger 28 includes multiple holes 296 spaced around the circumference of the casing hanger 28. In certain embodiments, the multiple holes 296 may be drilled through an outer circumferential surface 298 and a first annular planar surface 300 of the casing hanger 28. In the illustrated embodiment, the multiple holes 296 may be drilled at a particular angle 302 (e.g., acute angle or parallel) with respect to the centerline 60 of the well, and by extension, the centerline of the casing string 56. For example, the angle 302 may be zero (e.g., parallel) relative to the centerline 60, or the angle 302 may be an acute angle between 5 to 60, 10 to 45, or 15 to 30 degrees.

In some embodiments, the multiple holes 296 may include a counterbore feature in the hole that enables a fastener to sit in the counterbore feature such that a portion of the fastener may extend past the casing hanger 28 and into the string groove 294. The fastener 292, by virtue of this portion that extends into the string groove 294 may physically restrict a rotation of the casing string 56 in relation to the casing hanger 28, thereby enabling the casing hanger 28 to transmit a rotational torque to the casing string 56. However, in the illustrated embodiment, the fastener 292 may only thread into the hole 296 in the casing hanger 28 while not threading into the string groove 294 in the casing string 56. For example, the string groove 294 may be a circular or rectangular slot, which may be slightly oversized relative to a tip portion of the fastener 292. In some embodiments, an entrance into the string groove 294 may be tapered to facilitate self-alignment of the fastener 292 into the string groove 294. In some embodiments, the fastener 292 may be a non-threaded pin coupled to the casing hanger 28 by an annular flange or other mounting structure. For example, an annular flange may support a plurality of the fasteners 292, wherein the annular flange is separately coupled to the casing hanger 28 via a welded joint, a plurality of bolts, or a combination thereof. Additionally, the fasteners 292 and/or the annular flange may include one or more seals to block fluid leakage through the holes 296. In some embodiments, the mechanical rotational locking feature 290 may include six (6) fasteners 292, holes 296, and string grooves 294, however, greater or fewer (2, 3, 4, 5, 7, 8, 9, 10, etc.) mechanical features are considered within the scope of the present disclosure. In certain embodiments, a hole 296 may include a threaded portion 304 to engage with the fastener 292 to keep the fastener 292 in place during operation.

Figure 7:
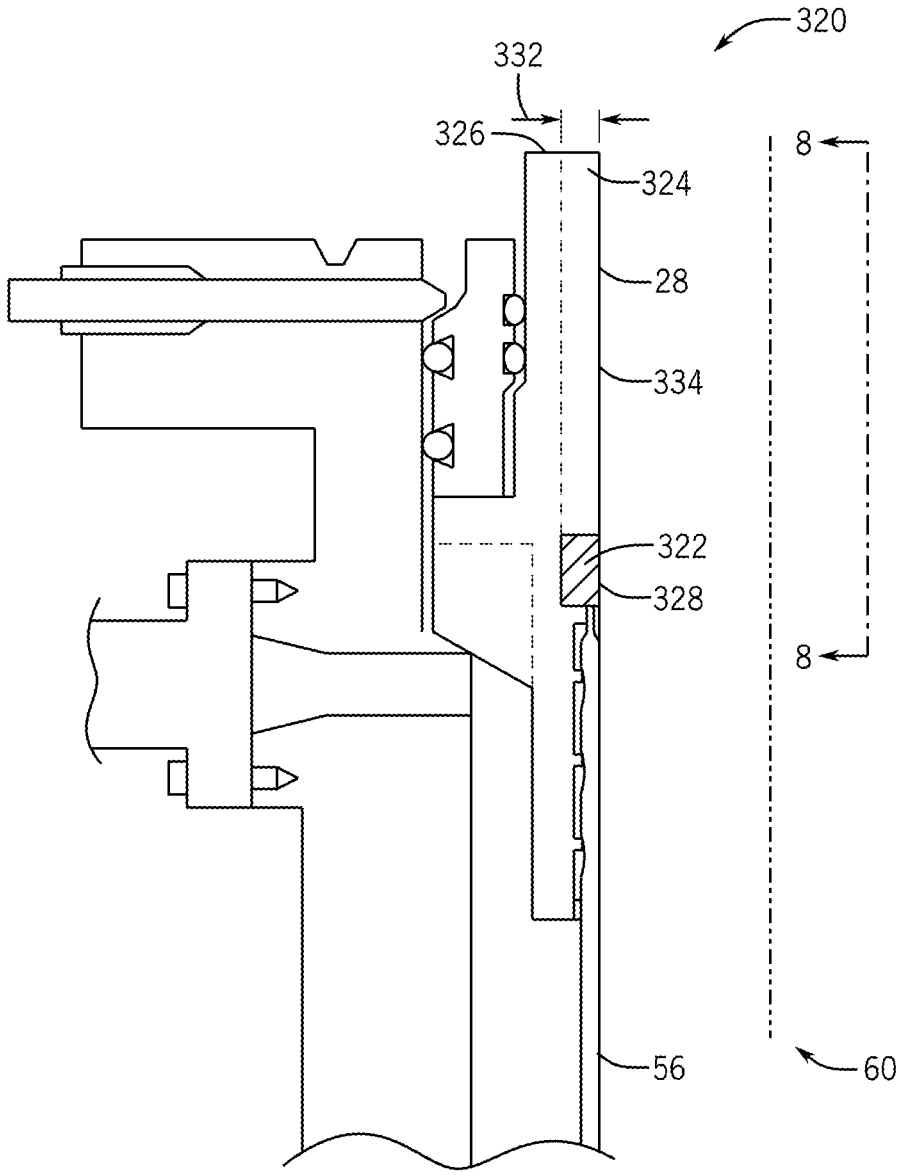
FIG. 7 is a cross-sectional side view of an embodiment for a mechanical rotational locking feature between the casing string and the casing hanger, in accordance with aspects of the present disclosure.

FIG. 7 illustrates a cross-sectional side view of an embodiment of an another alternative mechanical rotational locking feature 320 between the casing hanger 28 and the casing string 56. As discussed previously, the mechanical rotational locking feature 320 enables the casing hanger 28 to transmit a rotational torque to the casing string 56 without using a threaded connection between the casing hanger 28 and the casing string 56 (e.g., without threading together annular surfaces of the casing hanger 28 and the casing string 56). In the illustrated embodiment, the mechanical rotational locking feature 320 includes one or multiple axial lock keys 322 (e.g., keystock, rectangular bar stock, etc.) that are configured to assemble axially into a string groove 328 in the casing string 56. As illustrated, the casing hanger 28 includes one or multiple axial slots 324 spaced around the circumference of the casing hanger 28. In certain embodiments, the one or multiple axial slots 324 may extend from a first annular planar surface 326 in an axial direction along a length of the casing hanger 28. Additionally, the one or multiple axial slots 324 may extend a depth 332 (e.g., a radial depth) into the inner circumferential surface 334 (e.g., inner annular surface) of the casing hanger 28. In some embodiments, the one or multiple axial slots 324 may run parallel with the centerline 60 of the casing string 56.

In some embodiments, the axial slots 324 may enable the lock keys 322 to sit in the string groove 328 in the casing string 56, while also sitting in the axial slots 324 of the casing hanger 28. The lock keys 322, by virtue of this portion that extends into the string groove 328, may physically restrict a rotation of the casing string 56 in relation to the casing hanger 28, thereby enabling the casing hanger 28 to transmit a rotational torque to the casing string 56. For example, the string groove 328 may be a rectangular slot, which may be slightly oversized relative to the portion of the lock key 322 that sits in the string groove 328. In some embodiments, the axial slots 324 may have a sufficient depth, such that the lock key 322 may sit recessed from the inner circumferential surface 334. In some embodiments, an entrance into the string groove 328 may be tapered to facilitate self-alignment of the lock key 322 into the string groove 328. In some embodiments, the mechanical rotational locking feature 320 may include six (6) sets of the lock keys 322, the axial slots 324, and the string grooves 328. However, greater or fewer (2, 3, 4, 5, 7, 8, 9, 10, etc.) sets of the lock keys 322, the axial slots 324, and the string grooves 328 are considered within the scope of the present disclosure.

Figure 8:
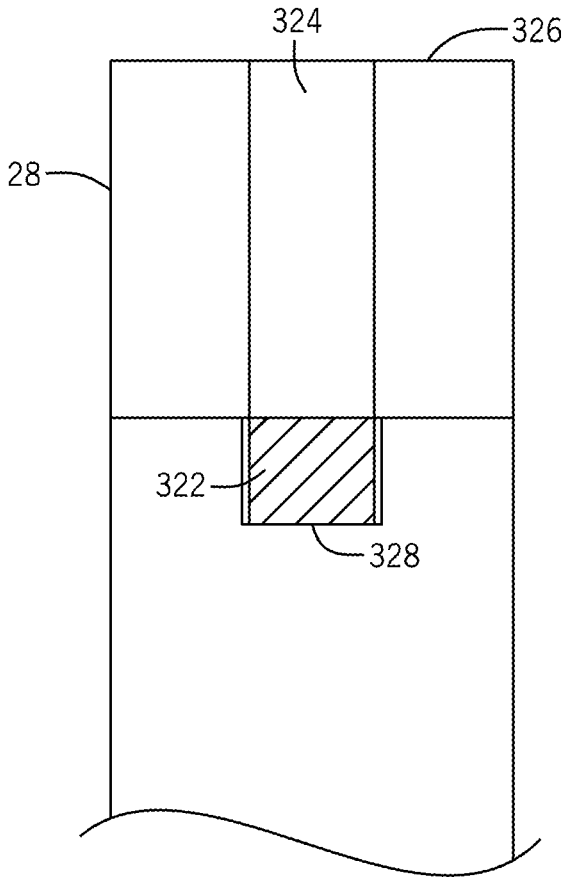
FIG. 8 is a side view of an embodiment for a mechanical rotational locking feature between the casing string and the casing hanger, in accordance with aspects of the present disclosure.

FIG. 8 illustrates a side view of an embodiment of the mechanical rotational locking feature 320 between the casing string 56 and the casing hanger 28 having the axial slot 324 of FIG. 7 taken along line 8-8, according to aspects of the present disclosure. In the illustrated embodiment, as discussed previously, the lock key 322 sits in the string groove 328 of the casing string 56 and the axial slot 324 of the casing hanger 28. The lock key 322, by virtue of this portion that extends into the string groove 328 may physically restrict a rotation of the casing string 56 in relation to the casing hanger 28, thereby enabling the casing hanger 28 to transmit a rotational torque to the casing string 56.

Figure 9:
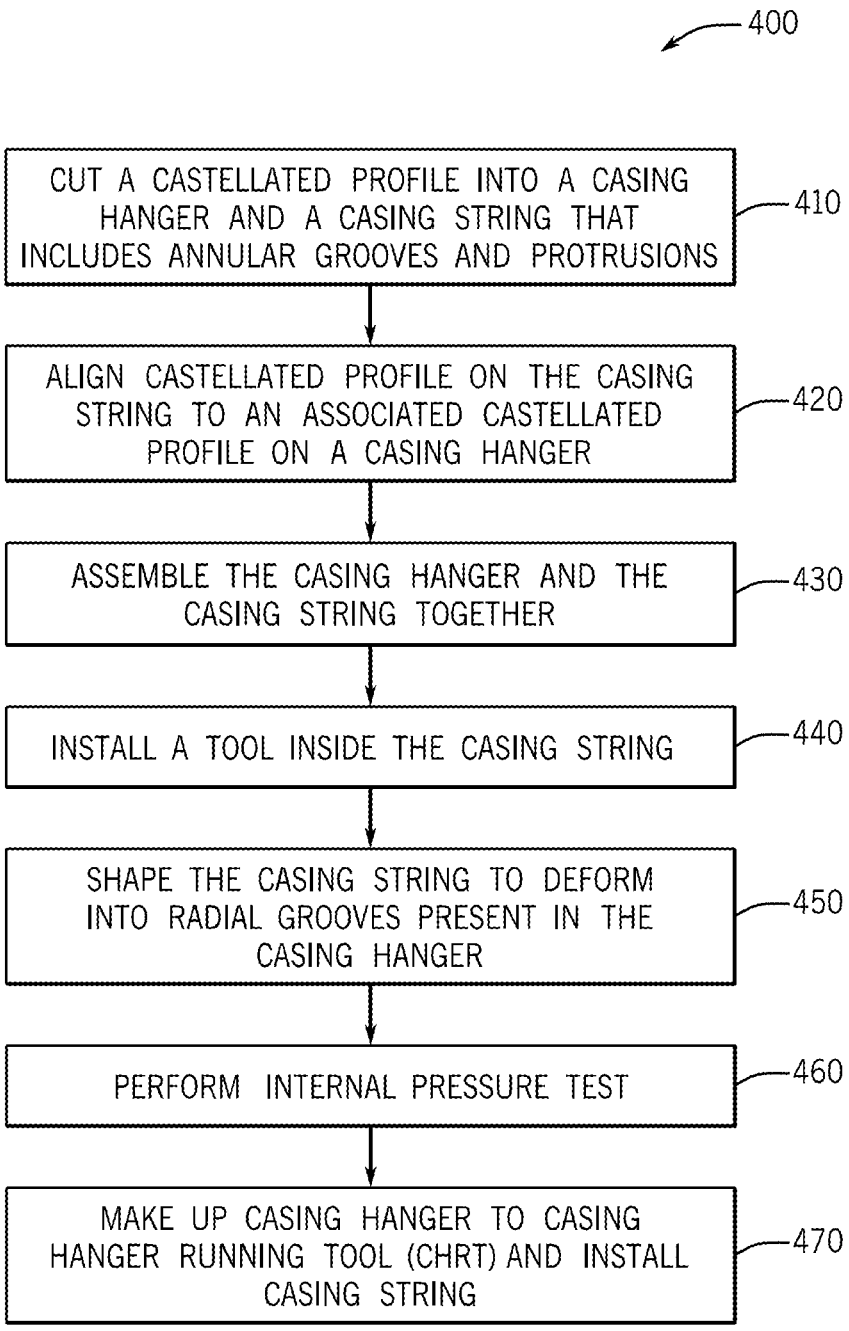
FIG. 9 is a flowchart of an embodiment of a method for arranging and assembling the casing string into the casing hanger, in accordance with aspects of the present disclosure.

FIG. 9 illustrates a flowchart of an embodiment of a method 400 for creating the mechanical rotational locking feature 150 between the casing hanger 28 and the casing string 56, and assembling the casing hanger 28 and the casing string 56 together. In particular, the method 400 prepares and creates the connection interface (e.g., annular castellated profiles 151 and 153) between the casing hanger 28 and the casing string 56 that enables the casing hanger 28 to transmit a rotational torque to the casing string 56 without a threaded interface. The method 400 is taken in context of the mechanical rotational locking feature 150 including the casing hanger 28, the casing string 56, and the various grooves and protrusions discussed in FIGS. 3-5. At block 410, a computer or processor-based controller (or an operator) controls a machine to cut the annular castellated profile 151 into the axial end surface 172 of the casing hanger 28 that includes hanger protrusions 152 and hanger grooves 158, and also to cut the annular castellated profile 153 into the axial end surface 174 of the casing string 56 that includes multiple string grooves 154 and string protrusions 156. In some embodiments, the machine may cut the annular castellated profiles 151 and/or 153 on site at the drilling and production facilities, and in other embodiments, the casing string 56 may have the annular castellated profiles 151 and/or 153 cut prior to arriving at the drilling and production facilities. For example, in some embodiments, the annular castellated profile 151 is cut into the casing hanger 28 offsite (e.g., during manufacturing), whereas the annular castellated profile 153 is cut into the casing string 56 onsite during drilling operations.

At block 420, the annular castellated profile 153 on the casing string 56 is aligned with an associated annular castellated profile 151 on the casing hanger 28. For example, the string grooves 154 of the casing string 56 may align with the hanger protrusions 152 of the casing hanger 28, and additionally, the hanger grooves 158 of the casing hanger 28 may align with the string protrusions 156 of the casing string 56. At block 430, the casing hanger 28 assembles together with the casing string 56. In some embodiments, the casing hanger 28 may move downward in an axially direction until it comes into contact with the casing string 56. In certain embodiments, the casing hanger 28 will axially overlap with the casing string 56 by a specified axial overlap distance 87. The interface between the grooves and protrusions on the casing hanger 28 and the associated grooves and protrusions on the casing string 56 create the mechanical rotational locking feature 150 that is configured to transmit a rotational torque from the casing hanger 28 to the casing string 56.

At block 440, a tool 92 is assembled inside the casing string 56. The tool 92 is configured to include an inflatable diaphragm 96 and a first radial seal 97 disposed above the inflatable diaphragm 96 and a second radial seal 98 disposed below the inflatable diaphragm. In some embodiments, the inflatable diaphragm 96 of the tool 92 aligns with the axial overlap distance 87. At block 450, the tool 92 causes the inflatable diaphragm 96 to expand, thereby enacting a radial force onto the inner circumferential surface 88 of the casing string 56. Due to the radial force, the outer circumferential surface 86 of the casing string 56 expands and deforms into the radial grooves 94 of the inner circumferential surface 82 of the casing hanger 28.

At block 460, an operator may perform an internal pressure test utilizing the tool 92 still assembled in the casing string 56. The internal pressure test ensures that the metal to metal seal (e.g., annular seal) that is formed as a result of the outer circumferential surface 86 of the casing string expanding and deforming into the radial grooves 94 of the inner circumferential surface 82 of the casing hanger 28 is sufficient to hold up against the elevated pressures present in the wellbore 20. In some embodiments, a single internal pressure test may be performed, while in other embodiments, multiple internal pressure tests are performed. Once a suitable number of internal pressure tests are performed, and the metal to metal seal between the casing hanger 28 and the casing string 56 has been evaluated and approved, the casing string 56 may be installed into the wellbore 20. At block 470, the CHRT 30 may couple to the casing hanger 28 and install the casing string 56 into the wellbore. As a result of the mechanical rotational locking feature 150 that exists between the casing hanger 28 and the casing string 56, the CHRT 30 may introduce a rotational torque to the casing hanger 28, and thereby pass along a rotational torque to the casing string 56.

The technical effect of the disclosed embodiments include improved installation techniques of a casing string via a mechanically rotational locking feature (e.g., mating annular castellated profiles) between the casing string and a casing hanger. In the illustrated embodiments, an annular castellated profile including multiple grooves and protrusions enable the casing hanger to transmit a rotational torque to the casing string, without relying on a threaded connection between the casing hanger and the casing string. By using this mechanical rotational locking feature, the interface between the casing hanger and the casing string may be simplified, and the connection interface may be standardized among various drilling and production facilities, rather than depending on multiple vendors and different threads for this connection.

The subject matter described in detail above may be defined by one or more clauses, as set forth below.

In certain embodiments, a system includes a casing hanger that includes a first castellated profile and a casing string that includes a second castellated profile such that the first castellated profile is configured to assemble with the second castellated profile to form a mechanical rotational locking feature configured to enable transfer of a rotational torque between the casing hanger and the casing string.

The system of the preceding embodiment, wherein the casing hanger includes a first inner circumferential surface, a first outer circumferential surface, and a first end annular surface that includes a plurality of hanger grooves and a plurality of hanger protrusions that extend at least partially between the first inner circumferential surface and the first outer circumferential surface, wherein the plurality of hanger grooves and the plurality of hanger protrusions combine to create the first castellated profile; and the casing string includes a second inner circumferential surface, a second outer circumferential surface, wherein the second outer circumferential surface is configured to slide into and interface with the first inner circumferential surface of the casing hanger; and a second end annular surface that includes a plurality of string grooves and a plurality of string protrusions that extend at least partially between the second inner circumferential surface and second outer circumferential surface, wherein the plurality of string grooves and the plurality of string protrusions combine to create the second castellated profile.

The system of any preceding embodiment, wherein each hanger groove of the plurality of hanger grooves includes a first hanger groove surface, a second hanger groove surface laterally spaced from the first hanger groove surface, wherein a first distance between the first hanger groove surface and the second hanger groove surface includes a hanger groove width, and a third hanger groove surface laterally spaced from the first end annular surface, wherein a second distance between the third hanger groove surface and the first end annular surface includes a hanger groove depth.

The system of any preceding embodiment, wherein each hanger protrusion of the plurality of hanger protrusions includes a first hanger protrusion surface, and a second hanger protrusion surface laterally spaced from the first hanger protrusion surface, wherein a third distance between the first hanger protrusion surface and the second hanger protrusion surface includes a hanger protrusion width.

The system of any preceding embodiment, wherein the first hanger groove surface is parallel to the second hanger groove surface, and the first hanger protrusion surface is parallel to the second hanger protrusion surface.

The system of any preceding embodiment, wherein the hanger groove width is larger than the hanger protrusion width, or the hanger protrusion width is larger than the hanger groove width.

The system of any preceding embodiment, wherein the hanger protrusion width is equal to the hanger groove width.

The system of any preceding embodiment, wherein each string groove of the plurality of string grooves includes, a first string groove surface, a second string groove surface laterally spaced from the first string groove surface, wherein a first distance between the first string groove surface and the second string groove surface includes a string groove width; and a third string groove surface laterally spaced from the first end annular surface, wherein a second distance between the third string groove surface and the first end annular surface includes a string groove depth.

The system of any preceding embodiment, wherein each string protrusion of the plurality of string protrusions includes a first string protrusion surface, and a second string protrusion surface laterally spaced from the first string protrusion surface, wherein a third distance between the first string protrusion surface and the second string protrusion surface comprises a string protrusion width.

The system of any preceding embodiment, wherein the first string groove surface is parallel to the second string groove surface, and the first string protrusion surface is parallel to the second string protrusion surface.

The system of any preceding embodiment, wherein the string groove width is larger than the string protrusion width, or the string protrusion width is larger than the string groove width.

The system of any preceding embodiment, wherein the string protrusion width is equal to the string groove width.

The system of any preceding embodiment, wherein the first castellated profile comprises a first alternating arrangement of a plurality of hanger grooves and a plurality of hanger protrusions, the second castellated profile comprises a second alternating arrangement of a plurality of string grooves and a plurality of string protrusions, the plurality of hanger grooves are sized to mate with the plurality of string protrusions, and the plurality of hanger protrusions are sized to mate with the plurality of string grooves.

The system of any preceding embodiment, wherein each of the plurality of hanger grooves and each of the plurality of string grooves include a rectangular groove, and wherein each of the plurality of hanger protrusions and each of the plurality of string protrusions includes a rectangular protrusion.

The system of any preceding embodiment, wherein each of the plurality of hanger grooves is uniformly sized and spaced about the casing hanger, each of the plurality of hanger protrusions is uniformly sized and spaced about the casing hanger, each of the plurality of string grooves is uniformly sized and spaced about the casing string, and each of the plurality of string protrusions is uniformly sized and spaced about the casing string.

In certain embodiments, a system includes a casing hanger or a casing string that includes a first inner circumferential surface, a first outer circumferential surface, and a first end annular surface that includes a plurality of grooves and a plurality of protrusions that extend at least partially between the first inner circumferential surface and the first outer circumferential surface, such that the plurality of grooves and the plurality of protrusions combine to create a first castellated profile, such that the first castellated profile is configured to mate with a second castellated profile to create a castellated interface between the casing hanger and the casing string.

The system of the preceding embodiment, wherein each of the plurality of grooves comprise a rectangular groove and each of the plurality of protrusions comprises a rectangular protrusion.

The system of any preceding embodiment, wherein each of the plurality of grooves is uniformly sized and spaced about the first end annular surface, and each of the plurality of protrusions is uniformly sized and spaced about the first end annular surface.

In certain embodiments, a method includes mating a first castellated profile of a casing hanger with a second castellated profile of a casing string to form a mechanical rotational locking feature, and transferring a rotational torque between the casing hanger and the casing string via the first and second castellated profiles forming the mechanical rotational locking feature.

The method of the preceding embodiment, including drilling a wellbore while transferring the rotational torque.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A system, comprising:

a casing hanger comprising a first castellated profile; and a casing string comprising a second castellated profile, wherein the first castellated profile is configured to assemble with the second castellated profile to form a mechanical rotational locking feature configured to enable transfer of a rotational torque between the casing hanger and the casing string.

2. The system of claim 1, wherein:

the casing hanger comprises:

a first inner circumferential surface;

a first outer circumferential surface; and a first end annular surface comprising a plurality of hanger grooves and a plurality of hanger protrusions that extend at least partially between the first inner circumferential surface and the first outer circumferential surface, wherein the plurality of hanger grooves and the plurality of hanger protrusions combine to create the first castellated profile; and the casing string comprises:

a second inner circumferential surface;

a second outer circumferential surface, wherein the second outer circumferential surface is configured to slide into and interface with the first inner circumferential surface of the casing hanger; and a second end annular surface comprising a plurality of string grooves and a plurality of string protrusions that extend at least partially between the second inner circumferential surface and the second outer circumferential surface, wherein the plurality of string grooves and the plurality of string protrusions combine to create the second castellated profile.

3. The system of claim 2, wherein each hanger groove of the plurality of hanger grooves comprises:

a first hanger groove surface;

a second hanger groove surface laterally spaced from the first hanger groove surface, wherein a first distance between the first hanger groove surface and the second hanger groove surface comprises a hanger groove width; and a third hanger groove surface laterally spaced from the first end annular surface, wherein a second distance between the third hanger groove surface and the first end annular surface comprises a hanger groove depth.

4. The system of claim 3, wherein each hanger protrusion of the plurality of hanger protrusions comprises:

a first hanger protrusion surface; and a second hanger protrusion surface laterally spaced from the first hanger protrusion surface, wherein a third distance between the first hanger protrusion surface and the second hanger protrusion surface comprises a hanger protrusion width.

5. The system of claim 4, wherein the first hanger groove surface is parallel to the second hanger groove surface, and the first hanger protrusion surface is parallel to the second hanger protrusion surface.

6. The system of claim 4, wherein the hanger groove width is larger than the hanger protrusion width, or the hanger protrusion width is larger than the hanger groove width.

7. The system of claim 4, wherein the hanger protrusion width is equal to the hanger groove width.

8. The system of claim 2, wherein each string groove of the plurality of string grooves comprises:

a first string groove surface;

a second string groove surface laterally spaced from the first string groove surface, wherein a first distance between the first string groove surface and the second string groove surface comprises a string groove width; and a third string groove surface laterally spaced from the first end annular surface, wherein a second distance between the third string groove surface and the first end annular surface comprises a string groove depth.

9. The system of claim 8, wherein each string protrusion of the plurality of string protrusions comprises:

a first string protrusion surface; and a second string protrusion surface laterally spaced from the first string protrusion surface, wherein a third distance between the first string protrusion surface and the second string protrusion surface comprises a string protrusion width.

10. The system of claim 9, wherein the first string groove surface is parallel to the second string groove surface, and the first string protrusion surface is parallel to the second string protrusion surface.

11. The system of claim 9, wherein the string groove width is larger than the string protrusion width, or the string protrusion width is larger than the string groove width.

12. The system of claim 9, wherein the string protrusion width is equal to the string groove width.

13. The system of claim 1, wherein the first castellated profile comprises a first alternating arrangement of a plurality of hanger grooves and a plurality of hanger protrusions, the second castellated profile comprises a second alternating arrangement of a plurality of string grooves and a plurality of string protrusions, the plurality of hanger grooves are sized to mate with the plurality of string protrusions, and the plurality of hanger protrusions are sized to mate with the plurality of string grooves.

14. The system of claim 13, wherein each of the plurality of hanger grooves and each of the plurality of string grooves comprise a rectangular groove, and wherein each of the plurality of hanger protrusions and each of the plurality of string protrusions comprises a rectangular protrusion.

15. The system of claim 13, wherein each of the plurality of hanger grooves is uniformly sized and spaced about the casing hanger, each of the plurality of hanger protrusions is uniformly sized and spaced about the casing hanger, each of the plurality of string grooves is uniformly sized and spaced about the casing string, and each of the plurality of string protrusions is uniformly sized and spaced about the casing string.

16. A method, comprising:

mating a first castellated profile of a casing hanger with a second castellated profile of a casing string to form a mechanical rotational locking feature; and transferring a rotational torque between the casing hanger and the casing string via the first and second castellated profiles forming the mechanical rotational locking feature.

17. The method of claim 16, comprising drilling a wellbore while transferring the rotational torque.

* * * * *